US012203334B2

(12) United States Patent
Cockrill et al.

(10) Patent No.: US 12,203,334 B2
(45) Date of Patent: Jan. 21, 2025

(54) HIGH EXPANDABLE STRADDLE

(71) Applicant: Vertice Oil Tools, Inc., Stafford, TX (US)

(72) Inventors: Christopher Cockrill, Westhill (GB); Philip Turrell, Westhill (GB); William Luke McElligott, Westhill (GB); Cameron Radtke, Westhill (GB)

(73) Assignee: Vertice Oil Tools, Inc., Stafford, TX (US)

( * ) Notice: Subject to any disclaimer, the term of this patent is extended or adjusted under 35 U.S.C. 154(b) by 0 days.

(21) Appl. No.: 18/533,478

(22) Filed: Dec. 8, 2023

(65) Prior Publication Data

US 2024/0110458 A1 Apr. 4, 2024

Related U.S. Application Data

(63) Continuation of application No. PCT/EP2022/065921, filed on Jun. 11, 2022.

(51) Int. Cl.
*E21B 33/124* (2006.01)
*E21B 33/127* (2006.01)

(52) U.S. Cl.
CPC ..... *E21B 33/1243* (2013.01); *E21B 33/1277* (2013.01)

(58) Field of Classification Search
CPC ..... E21B 33/1243; E21B 33/1277
See application file for complete search history.

(56) References Cited

U.S. PATENT DOCUMENTS

| | | | | | |
|---|---|---|---|---|---|
| 2,652,894 | A * | 9/1953 | Brown | E21B 33/129 | 166/134 |
| 4,714,117 | A * | 12/1987 | Dech | E21B 33/13 | 166/380 |
| 4,923,007 | A * | 5/1990 | Sanford | E21B 33/1277 | 166/187 |
| 5,361,836 | A * | 11/1994 | Sorem | E21B 33/1243 | 166/187 |
| 10,428,617 | B2 * | 10/2019 | Radtke | E21B 33/1285 | |
| 11,242,729 | B2 * | 2/2022 | Vasques | E21B 34/10 | |
| 2003/0116328 | A1 * | 6/2003 | Doane | E21B 33/1208 | 166/182 |
| 2006/0042801 | A1 * | 3/2006 | Hackworth | E21B 43/103 | 166/387 |
| 2012/0211232 | A1 * | 8/2012 | Grodem | E21B 33/1294 | 166/341 |
| 2016/0097254 | A1 * | 4/2016 | Wood | E21B 33/127 | 166/387 |

(Continued)

*Primary Examiner* — Shane Bomar
(74) *Attorney, Agent, or Firm* — Pierson IP, PLLC

(57) ABSTRACT

A high expandable straddle and a method of providing annular isolation at a location in a well bore. The straddle includes two expandable pipe sections with a base pipe section therebetween and end pipe sections for connection in a tubular string. The straddle may be run in tubing with restricted inner diameters and by the introduction of pressure to the saddle over 30% expansion can occur to the expandable pipe sections to seal and grip the tubing spanning a fault. An embodiment is described with the straddle being of unitary construction, the expansion pipe sections having thinned walls and being entirely formed of an austenitic stainless steel. An anchoring arrangement and/or seals may also be located on the expandable pipe sections.

20 Claims, 5 Drawing Sheets

(56) References Cited

U.S. PATENT DOCUMENTS

| | | | | |
|---|---|---|---|---|
| 2019/0178048 | A1* | 6/2019 | Krüger | E21B 33/126 |
| 2019/0301264 | A1* | 10/2019 | Radtke | E21B 33/1277 |
| 2019/0316437 | A1* | 10/2019 | Bardsen et al. | E21B 33/126 |
| 2020/0088007 | A1* | 3/2020 | Radtke | E21B 33/1277 |

* cited by examiner

HIGH EXPANDABLE STRADDLE

BACKGROUND INFORMATION

Field of the Disclosure

The present invention relates to an apparatus and method for anchoring a tubular within another tubular or borehole and creating a seal across an annulus in a well bore. In particular, the invention relates to a high expandable straddle to provide annular isolation in a well bore.

Background

Conventionally, during the drilling, production or workover phase of an oil, water or gas well, there may be a requirement to provide a patch or temporary casing across an interval, such as a damaged section of liner, leaking connection or an open hole section of the borehole. U.S. Pat. No. 3,297,092 describes an early casing patch comprising a corrugated liner tube and an expandable cone. U.S. Pat. No. 5,083,608 describes an arrangement for patching off troublesome zones in a well having a string of profile pipes with cylindrical portions at their ends, and a device for setting the string of profile pipes in a well, mounted for longitudinal reciprocation inside the string of profile pipes. Said device includes a reamer of the cylindrical portions of the profile pipes, positioned inside the uppermost cylindrical portion of the string of profile pipes, rigidly connected with an expander positioned above the string of profile pipes and having a housing with expanding elements mounted thereon. U.S. Pat. No. 7,017,670 describes an apparatus for securing a tubular member within a liner or borehole has a seal means connected within the tubular member, and a pressure control device operable to increase the pressure within the tubular member, such that operation of the pressure control means causes the tubular member to move radially outwardly to bear against the inner surface of the liner or borehole wall.

Packers are also well known in the exploration and production of oil and gas wells and used to form a seal between tubular members, such as a liner, mandrel, production tubing and casing or between a tubular member, typically casing, and the wall of an open borehole. The seal prevents fluid flow in the annulus and can therefore be used to isolate portions of the annulus and allow access to distinct sections of the formation. Packers may also anchor an inner tubular to an outer tubular or borehole wall. These packers are carried into the well on tubing and at the desired location, a sleeve is inflated to cross the annulus and create a seal with the outer generally cylindrical structure i.e. another tubular member or the borehole wall. While the sleeves were originally formed of a rubber, the use of chemicals, effects of corrosion and the permanent requirements of the packer have meant they are now more commonly of primarily metal construction.

In a typical metal packer, such as disclosed in U.S. Pat. No. 7,306,033 there is a metal tubular body or mandrel, an expandable metal cylindrical sleeve positioned on the exterior of the tubular body with ends fixed to the tubular body, to create a chamber therebetween, and a port from the bore of the tubular body to the chamber so as to permit the flow of fluid into the chamber and cause the sleeve to move radially outwards and morph against the inner diameter of the larger diameter structure. The sleeve undergoes plastic deformation and, if morphed to a generally cylindrical metal structure, the metal structure will undergo elastic deformation to expand by a small percentage as contact is made.

When the pressure is released the metal structure returns to its original dimensions and will create a seal against the plastically deformed sleeve. During the morphing process, both the inner and outer surfaces of the sleeve will take up the shape of the surface of the wall of the cylindrical structure. The packer thus creates a morphed isolation barrier.

A disadvantage of the use of packers is that the repairs required in small diameter tubing such as standard 5½ " tubing mean that the packer must have a restricted outer diameter (OD) and in which any inflation tool must also be able to be located within. Such tubing is generally rated with a nominal inner diameter (ID) of 4.670". The problem is exacerbated if there are narrower restrictions in the tubing to reach the repair location, such as valves which provide a reduced nipple ID of, say, 3.437" so that any thru-tubing repair must meet this criteria while still being able to expand to the maximum ID which can exist, 4.765" for the 5½ " tubing.

It is therefore an object of the present invention to provide a high expandable straddle which obviates or mitigates at least one disadvantage of the prior art.

SUMMARY

According to a first aspect of the present invention there is provided a high expandable straddle to provide annular isolation in a well bore, comprising:

- first and second expandable pipe sections;
- a base pipe section located between the first and second expandable pipe sections; and
- first and second end pipe sections located at each end of the first and second expandable pipe sections respectively;
- the first and second expandable pipe sections being configured to expand radially outwards in contrast to the base pipe and end sections when pressure is applied to an inside surface of the pipe sections.

In this way, the straddle can be formed as a length of pipe which can be run through restrictions in tubing and then expanded to straddle a repair location. The base pipe section provides a defined through bore diameter at a downhole location, which is isolated from above and below. By straddling the downhole location, a seal or connection does not require to be made against tubing whose condition is not known i.e. split, leaking or damaged which could affect the quality of the seal made against it.

Preferably, a wall thickness of the first and second expandable pipe sections are smaller than the wall thickness of the base pipe and end sections. In this way, the expandable pipe sections will expand at lower pressures.

Preferably all the pipe sections are formed of a first material. Preferably the first material is a metal. More preferably the metal is an austenitic stainless steel.

In this way, the straddle is formed of a single pipe and welding is not required.

Preferably the pipe sections have a uniform outer diameter. In this way, the outer diameter can be close to the inner diameter of the smallest restricted ID in the tubing.

In an embodiment, the first and second expandable pipe sections are formed of a first material and the base and end pipe sections are formed of a second material, with the first material being more ductile than the second material. In this way materials can be selected for their expansion properties.

The pipe sections may be welded together end to end. Alternatively, a portion of the first and second expandable pipe sections overlap a portion of the base and end pipe sections. This provides support during welding.

The base and end pipe sections may have an outer diameter which is smaller than an outer diameter of the first and second expandable pipe sections.

By having the first and second expandable pipe sections with an increased diameter, a lower degree of expansion is required than as for a clad of only the diameter of the base pipe. Note that the base pipe does not extend through the first and second end pipe sections and thus these are not sleeves which simplifies the construction.

The first and second expandable pipe sections may include slips. These will assist in anchoring the straddle downhole. They may be reverse slips as disclosed in U.S. Ser. No. 10/428,617, the contents of which are incorporated herein by reference.

The first and second expandable pipe sections may have an outer surface which is provided with a deformable coating such as an elastomeric coating which may be configured as a single coating or multiple discreet bands. This improves the seal and prevents hydraulic lock when the expandable pipe sections are expanded.

Preferably the first material is steel. More preferably the first material is 316 steel.

According to a second aspect of the present invention there is provided a method of providing annular isolation at a location in a well bore, comprising the steps:

(a) locating a high expandable straddle according to the first aspect on a tubular string;

(b) running the tubular string into a wellbore and positioning the first and second expandable pipe sections at either side of the location within a larger diameter structure of the well bore;

(c) pumping fluid through the tubular string to cause the first expandable pipe section to move radially outwardly and morph against an inner surface of the larger diameter structure; and (d) pumping fluid through the tubular string to cause the second expandable pipe section to move radially outwardly and morph against an inner surface of the larger diameter structure.

In this way, the expandable pipe sections create a seal against the larger diameter structure to provide annular isolation on either side of the location in the well bore. The larger diameter structure may be an open hole borehole, a borehole lined with a casing or liner string which may be cemented in place downhole or may be a pipeline or other tubing located in the well bore.

Preferably, the method includes at steps (c) and (d), creating over 30% expansion in outer diameter to the first and second expandable pipe sections. More preferably, the expansion is over 40%.

The method may include the steps of running in a hydraulic fluid delivery tool, creating a temporary seal at the end pipe sections to isolate a space and injecting fluid from the tool into the space to morph the expandable pipe sections. Preferably the temporary seal is set against the end pipe sections. The hydraulic fluid delivery tool may be as described in GB2398312, the disclosure of which is incorporated herein by reference. The hydraulic fluid delivery tool may include an intensifier to increase fluid pressure at the straddle to morph the expandable pipe sections. The pressure intensifier may be as described in U.S. Ser. No. 10/066,466, the disclosure of which is incorporated herein by reference.

Steps (c) and (d) may be carried out consecutively or simultaneously.

The method may include the step of anchoring the first and/or second expandable pipe sections to the inner surface of the larger diameter structure. This may be by morphing gripping elements such as slips on the expandable pipe sections to engage the larger diameter structure.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

BRIEF DESCRIPTION OF THE DRAWINGS

Embodiments of the present invention will now be described, by way of example only, with reference to the accompanying drawings of which.

DETAILED DESCRIPTION

Figure 1A:
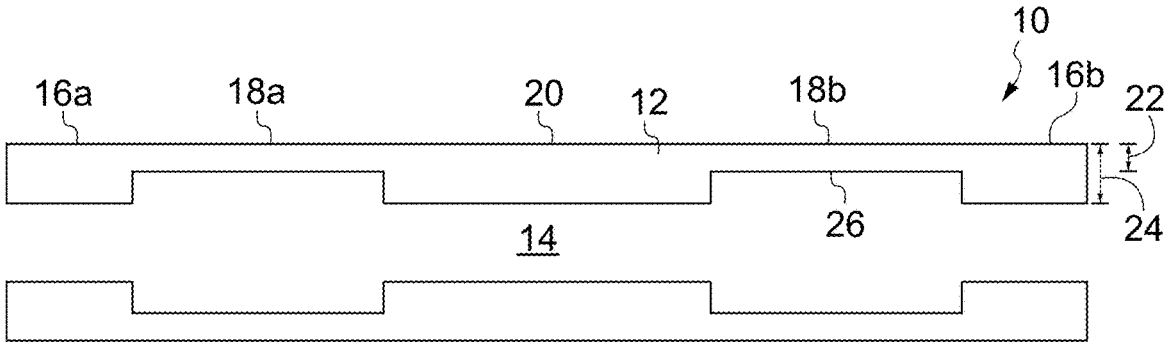
FIGS. 1(*a*) to 1(*c*) are cross sectional views through high expandable straddles according to embodiments of the present invention.
Figure 1B:
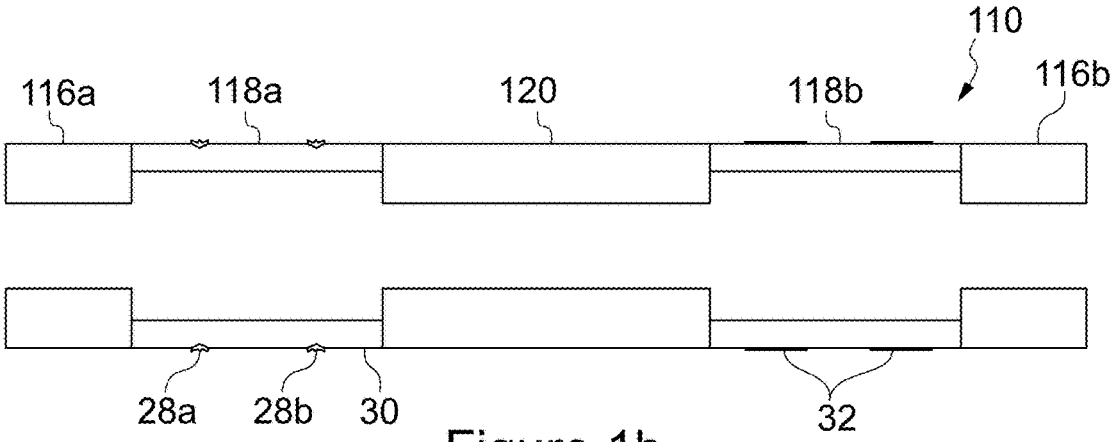
Figure 1C:
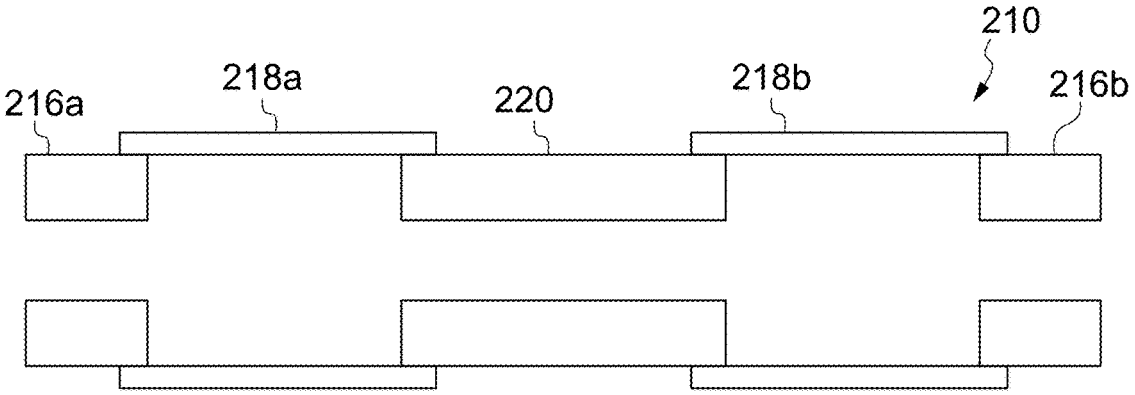

Referring initially to FIG. 1(*a*) of the drawings there is illustrated a high expandable straddle, generally indicated by reference numeral 10, according to an embodiment of the present invention. Straddle 10 has a cylindrical tubular body which may be considered as a pipe 12, having a through bore 14. The pipe 12 has five sections along its length: a first end pipe section 16*a*; a first expandable pipe section 18*a*; a base pipe section 20; a second expandable pipe section 18*b*; and a second end pipe section 16*b*. The pipe 12 is formed from a metal, preferably an austenitic stainless steel and is of unitary construction with a constant outer diameter (OD).

Of note is that the first and second expandable pipe sections 18*a,b* have a smaller wall thickness 22 than the wall thickness 24 of the base and end pipe sections 20,16*a,b*. the reduced weight in the expandable pipe sections 18*a,b* means that when pressure is applied in the through bore, they will yield and elastically deform to move radially outwards, expanding to increase the OD over the lengths of the expandable pipe sections 18*a,b*. The expandable pipe sections 18*a,b* will contact, anchor and seal against the tubing in the well which is to be repaired. The base pipe section 20 has a length sufficient to cover the region of the tubing which has the fault. The wall thickness 24 is selected so that the base and end pipe sections 20, 16*a,b* do not yield under the pressure and so provide a fixed diameter to both clear the fault at the base pipe section 20 and provide ends for standard connection to the tubular string on which the straddle 10 is run.

FIG. 1(*b*) illustrates a high expandable straddle, generally indicated by reference numeral 110, according to an embodiment of the present invention. Like parts to the straddle 10 of FIG. 1(*a*) have been given the same reference numeral with the addition of 100 to aid clarity. In straddle 110, the expandable pipe sections 118*a,b* are formed of a different metal than the base and end pipe sections 120, 116*a,b*. The expandable pipe sections 118*a,b* are formed from an austenitic stainless steel such as 316 stainless steel, while the base and end pipe sections 120,116*a,b* are formed of a carbon alloy steel such as 4130 or 4130*m* low carbon alloy steel. The carbon alloy steel is not as ductile as the stainless steel and will therefore not expand in contrast to the stainless steel which will expand when pressure is applied to the inner surface 26. The sections 116*a,b*,118*a,b*,120 are welded together end to end by known techniques.

Also shown on FIG. 1(*b*) are examples of anchoring and sealing features which can be used on the straddle. While they appear on this embodiment of a straddle, they can be applied singly or together on any expandable pipe section of any embodiment.

The first expandable pipe section 118*a* is shown with slips 28*a,b*. The slips 28*a,b* are as as disclosed in U.S. Ser. No. 10/428,617, the contents of which are incorporated herein by reference. The slips 28*a,b* provide an anchoring arrangement, with a recess located circumferentially around an outer surface 30 of the expandable pipe section, the recess having opposing side walls which are each tapered from a bottom of the recess to the outer surface; and at least one gripping element having an outward facing surface adapted to grip and an inclined edge; wherein the at least one gripping element is initially located within the recess and the inclined edge abuts one of the side walls of the recess; and upon morphing of the expandable pipe section under pressure the at least one gripping element is moved radially outwards by the morphing action on the pipe section to engage with the tubing on which the expandable pipe section 118*a* has sealed against.

The second expandable pipe section 118*b* is shown with the outer surface 30*b* having a deformable coating 32. The deformable coating is an elastomeric coating which may be configured as a single coating or multiple discreet bands. This rubber layer squeezes against the tubing and improves the seal while preventing hydraulic lock when the expandable pipe section 118*b* is expanded.

Referring to FIG. 1(*c*) there is illustrated a high expandable straddle, generally indicated by reference numeral 210, according to an embodiment of the present invention. Like parts to the straddle 10 of FIG. 1(*a*) have been given the same reference numeral with the addition of 200 to aid clarity. Like the straddle 110, the expandable pipe sections 218*a,b* are formed of a different metal than the base and end pipe sections 220, 216*a,b*. The expandable pipe sections 218*a,b* are formed from an austenitic stainless steel such as stainless steel, while the base and end pipe sections 220, 216*a,b* are formed of a carbon alloy steel such as 4130 or 4130*m* low carbon alloy. In this embodiment instead of the pipe sections being welded end to end. The pipe sections overlap with the inner diameter (ID) of the expandable pipe sections 218*a,b* being equal to the OD of the base and end pipe sections 220,216*a,b*. This embodiment provides a greater contact area for joining the sections to allow for other connections such as screw thread connections and seals to be used together with welding, but with the disadvantage that the OD of the straddle 210 may need to be greater for a given ID.

Figure 2A:
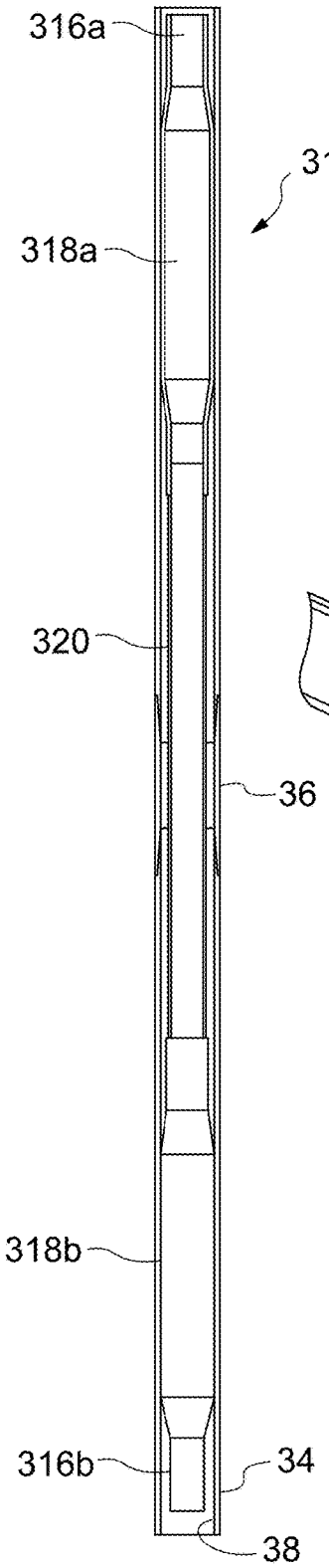
FIGS. 2(*a*) and 2(*b*) are schematic illustrations of a high expandable straddle in an expanded arrangement within casing in a well.
Figure 2B:
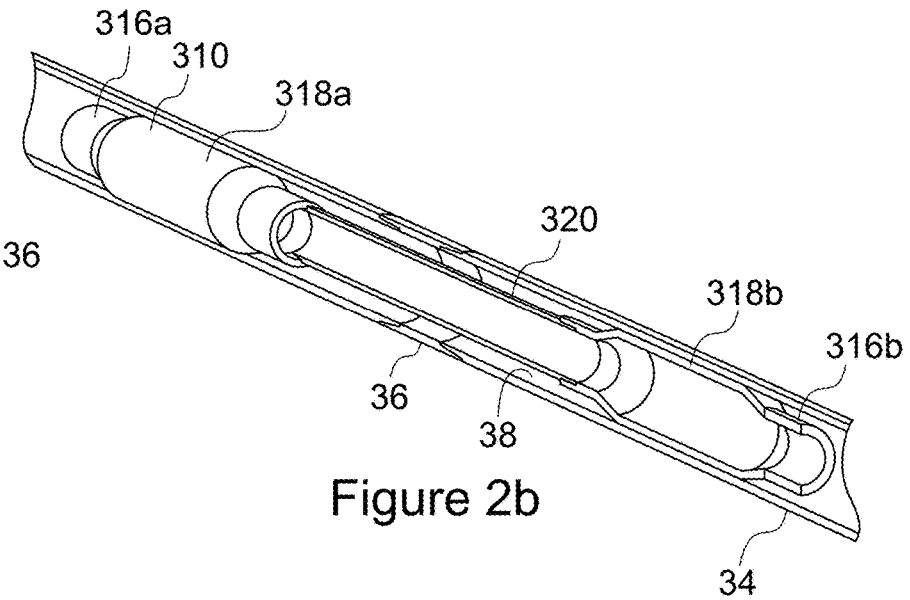

Reference is now made to FIGS. 2(*a*) and 2(*b*), giving a schematic illustration of a high expandable straddle, generally indicated by reference numeral 310, according to an embodiment of the present invention. Like parts to the straddle 10 of FIG. 1(*a*) have been given the same reference numeral with the addition of 300 to aid clarity. The straddle is now shown in expanded form within casing 34. We will describe the high expansion straddle 310 using expansion technology to isolate a portion of a tube 34 to repair a leak in a well bore. It is known that some wells can leak at connection points 36 between the tubulars 34 used in the well bore. These tubulars 34 come in standard diameters and, as an example only, we will consider a 5½" tubing connection 36. The high expansion straddle 310 of the present invention creates a thru-tubing solution that successfully seals and anchors across this leak, providing life of well integrity.

Straddle 310 creates a seal using two expandable pipe sections 318*a,b* connected by a base pipe section 20 being 2⅞" 6.4 lb/ft tubing. The length of the tubing can be altered to match the desired amount of connections 36 in the casing 34 that wish to be covered. The expandable pipe sections 318*a,b* will not only seal but will create the anchoring system between the straddle 310 and the inner surface 38 of the casing 34 at its ID.

For the example chosen, the straddle 310 covers a 5½" casing connection 36. This straddle could be run to depth on coiled tubing and set by either surface pumps pending the desired morphing pressure or on a specially engineered running tool used as a pressure intensifier to reach high pressures from low surface input. Such a pressure intensifier is described in U.S. Ser. No. 10/066,466 which is incorporated herein by reference. In the figures, the the straddle 310, is located in the 5½" tubing 34 across a possible leaking connection 36.

The straddle 310 consists of two high expansion sections 318*a,b* with 2⅞" base pipe between them. While not shown, in the high expansion sections 318*a,b* there will be sealing and anchoring features to withstand the forces acting on the system as described with reference to FIG. 1(*b*). To create a seal between the tubing 34 ID and the straddle a section of rubber would be installed on the OD of the high expansion pipe sections 318*a,b* and when expanded the rubber will squeeze against the tubing 34 ID and seal. The anchoring system will work in a comparable way with slips attached to the high expansion sections 318*a,b*, when the high expansion sections 318*a,b* are expanded these slips will bite into the tubing ID with the force generated from the expansion process.

The mechanical straddle 310 is deployed to depth through the minimum ID of a 4½" SCSSV nipple. Minimum ID of the nipple is 3.437" which gives a target max OD of the straddle 310 of 3.350" to ensure it will drift. The tubing 34 where the straddle will be set is 5½" 23 lb/ft tubing which has nominal ID of 4.670". API casing has an allowable tolerance range, and for this casing size and weight the max allowable casing ID is 4.765".

With a max OD of 3.35", the range of expansion percentages is shown in Table 1:

TABLE 1

Percentage Expansion Needed to Seal in Casing

| | Percentage Expansion to seal in Casing ID | | |
|---|---|---|---|
| Straddle OD | Min ID | Max ID | Nominal ID |
| 3.35 OD | 36.6% | 42.2% | 39.4% |

The entire system is preferably RIH on coiled tubing and deployed using a setting tool, possibly consisting of an accumulative piston arrangement as per the pressure intensifier described in U.S. Ser. No. 10/066,466. The setting tool will be retrieved from the straddle 310 and returned to surface leaving the straddle 310 behind which holds an internal pressure differential of 10,000 psi.

Additional environment considerations will be the temperature of the well, which is estimated to be between 50° F. and 250° F., and corrosion in the well so that the first and second materials are NACE compliant to withstand sulfide stress cracking (SSC) with the $H_2S$ partial pressure range of 0.4 psia.

The expansion of the expandable pipe sections 318*a,b* can be modelled using Finite Element Analysis (FEA) to meet the expansion ratio on a blank piece of pipe (3.35" OD) which will be expanded to into the max possible ID of the 5½" casing 34.

To ensure that the straddle 310 is feasible a full analysis of the various loads acting on parts is assessed. The forces acting on the straddle are mainly controlled by 3 variables: pressure differential, the flowrate inside the tubing/pipe sections and temperature.

The straddle 310 is based on a differential of 10,000 psi inside the tubing, this force generated from the pressure will be acting across the end face of the straddle to the sealing diameter on the tubing ID. This piston force has been calculated to show that a 135,000 lbs will be acting both above and below towards the center. Although in theory this piston load will be balanced, there will be compressive load acting on the straddle 310.

During injection, there is a force generated from the friction losses acting on the length of the pipe. This can be calculated through the Hazen-Williams equation, it shows that the pressure drop at 30,000 bpd is 0.00085 psi. The friction loss over the 20 ft pipe is so minute that it is negligible from the loads acting on the system.

Overall the rating of the straddle 310 will have to withstand a temperature range of 80° F. to 250° F., pressure differential of 10 ksi and 135,000 lbs compressive load.

One of the biggest considerations during the initial analysis is selecting the right material that is going to both match the 42% expansion and NACE environmental requirements.

When initially deciding on a material the flow curve derived from the non-linear stress strain data will be examined to provide further insight into the suitability of a particular steel. Specifically, we are interested not only in the total strain to failure but the strain at the onset of necking. Typical low alloy steels currently used for expanding will strain to 30% but will experience the onset of necking at 15-20%. Whilst it is possible, under certain conditions to exceed this, it can lead to consistency and reliability problems. For low alloy applications, we often use EN10225—S355 (approx. equivalent to API 5L L360/x55 or A572 Gr50), a structural steel commonly used in offshore applications, as it is readily available and has acceptable elongation properties.

However, for NACE applications, or applications requiring higher expansion, the austenitic stainless steels, typified by SAE 316 or 316L, generally work better. These steels exhibit a very flat flow curve and generally do not being to neck until 38-45% expansion, some samples will strain to 52% before necking and then failure. SAE 316L is a molybdenum bearing grade of stainless steel that is highly corrosion resistant and offers high resistance to creep and stress rupture, and is available in various lengths and sizes.

The problem to overcome for this application is that the strain required to go from a max allowable OD of 3.35" to a maximum casing ID of 4.765" is approximately 42%. To achieve this will require careful selection of stainless grades and detailed study/testing of strain behaviour. Given the 42% expansion is near the upper limit of these steels, the level of repeatability within a given batch of material will need to be determined for its use.

Figure 3:
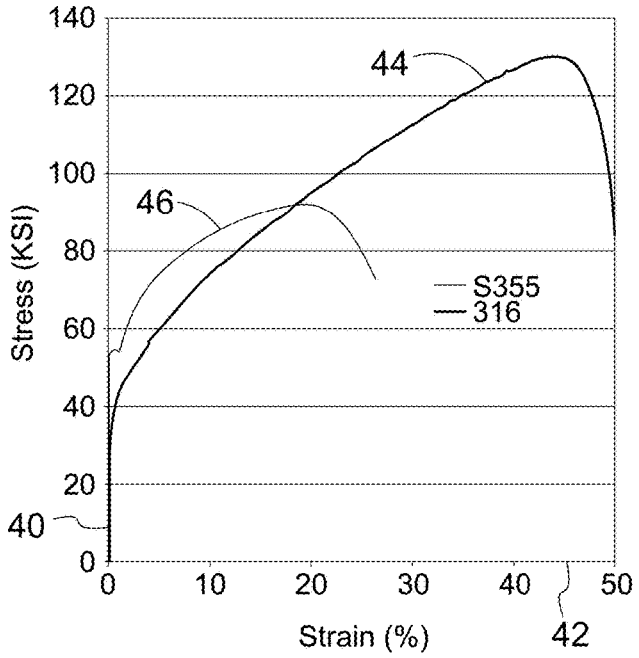
FIG. 3 is a graph of stress versus strain for two metals.

FIG. 3 is a stress 40 vs strain 42 graph. The examples in the graph show true stress strain curves 44,46 for 316 Stainless Steel and EN10225—S355—(approx. equivalent to API 5L L360/x55 or A572 Gr50) respectively. Here the S355 starts to neck at approx. 20 strain, leading to failure at 30%. The 316 does not onset necking until 46%, but rapidly fails by 50%. This example highlights one of the key attributes of a material suitable for the straddle 310.

Considering the deformation of expandable pipe sections 318*a,b* during the expansion process requires studying the mechanical properties of a material against the stresses incurred during the expansion stages. To achieve expansion and sealing the expandable material must be exposed to internal pressures that exceed the yield strength of the tube/material combination. Then the pressure increases to expand the material into the ID of the base 5½" casing that it is expanding into. Finally, some pressure overhead is required to ensure the expanded straddle is pushed hard against the base casing ID to ensure adequate seal compression.

FIGS. 4 to 8 show straddle models carried out to explore the strain range and contact pressures. They are presented in 2D axi-symmetric, this shows the initial geometry and final stages of expansion of a 316 steel expandable pipe section 318*a* with a yield strength of 33 ksi into a 5½" 23 lb/ft casing 34 at maximum ID of 4.765". The 316 expandable pipe section 318*a* is 3.35" OD 3.1" ID. The thicker end pieces 320,316*a* are 3.35" OD and 2.90" ID. This tapers down to the 2⅞" 6.4 lb/ft tubing ID of 2.441" out of the image.

Figure 4:
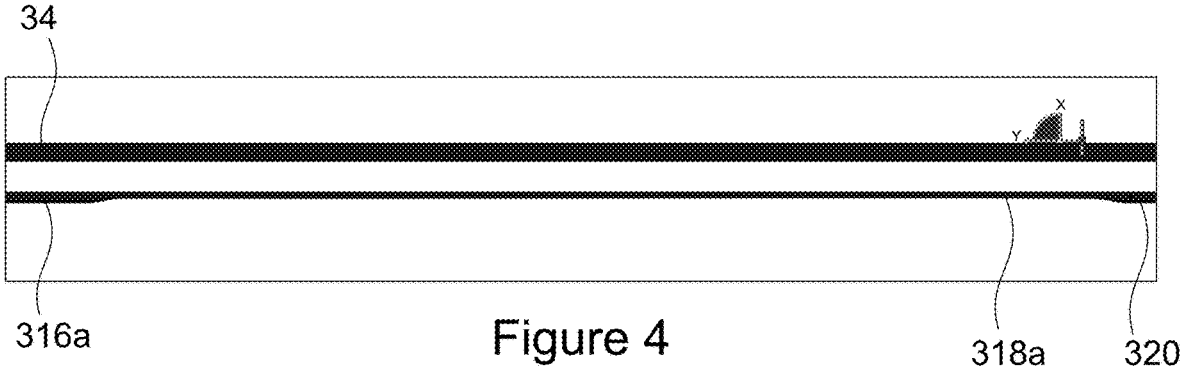
FIG. 4 is an image of a simplified straddle model showing the initial geometry of a straddle and casing.

FIG. 4 shows the initial geometry zoomed to central portion of one expandable pipe section of the straddle, shown inside 23 #casing ID. The upper object is the casing 34 located in the well bore, the lower object is the expandable pipe section 318*a* of one end of the straddle 310.

Figure 5:
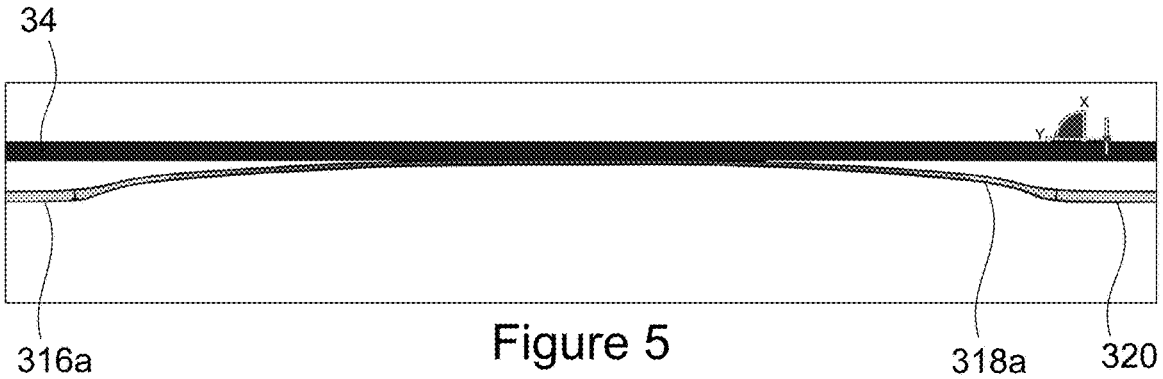
FIG. 5 is an image of the simplified straddle model showing initial contact between the straddle and casing.

FIG. 5 shows the expanded straddle 310 of FIG. 4 at approx. 5.4 ksi, showing first contact with 23 #casing ID. The straddle started to expand at the approximately 2.5 ksi. The grey contours show stress distribution.

Figure 6:
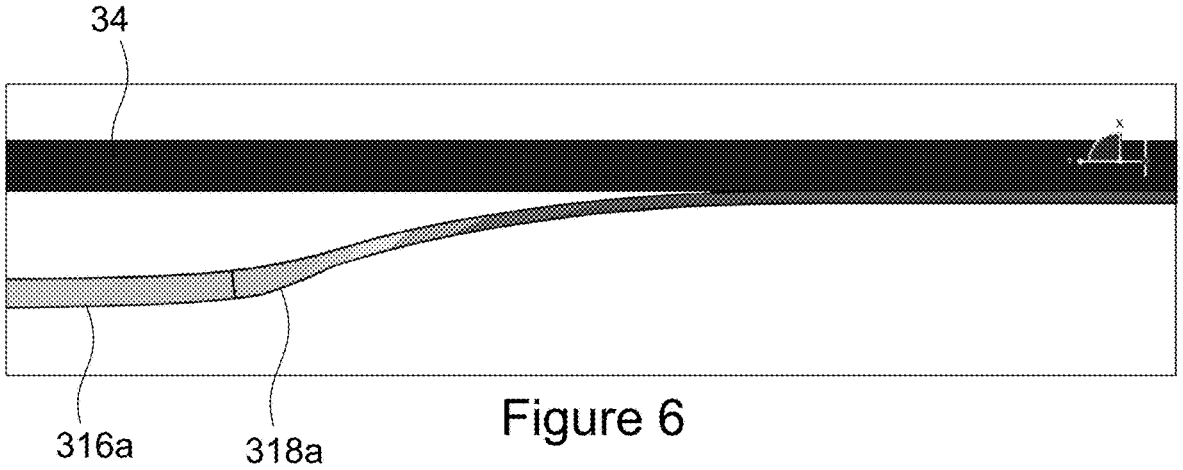
FIGS. 6, 7 and 8 are images of the simplified straddle model showing deformation for increasing internal pressures.
Figure 7:
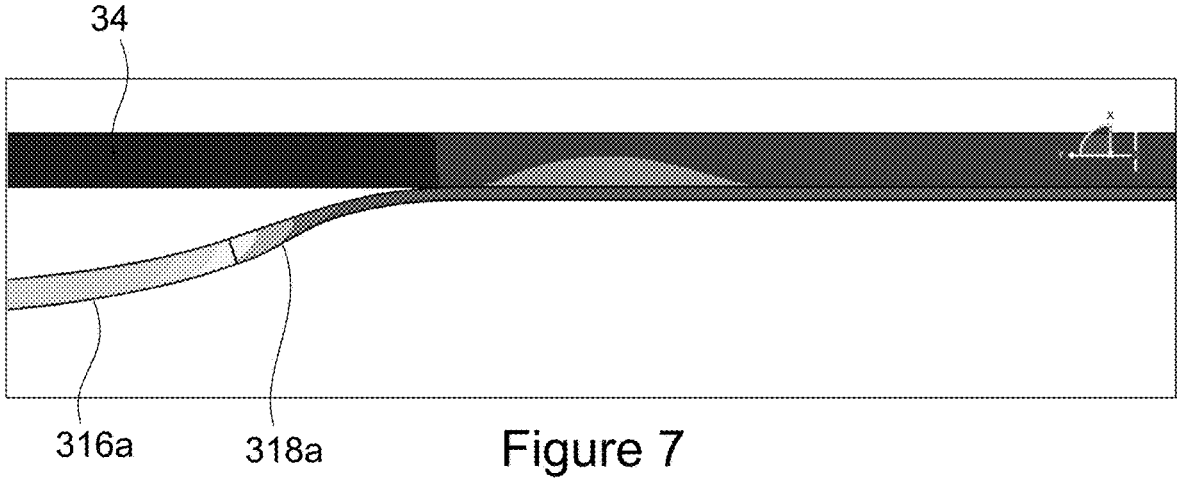
Figure 8:
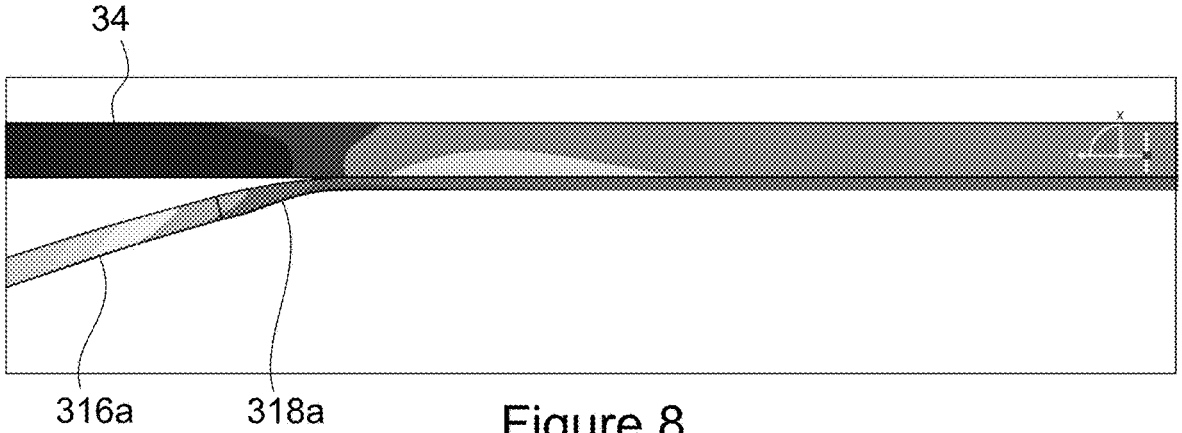

FIGS. 6, 7 and 8 are zoomed to one end of the expandable pipe section 318*a* of the straddle 310, showing details of the maximum expansion and the behavior of the transition zone between expanded portion of the straddle 310 and unexpanded section 320 at pressures of 6 ksi, 8 ksi and 10 ksi respectively. These three figures show the effect of increasing pressure beyond the initial contact pressure of 5.4 ksi, to force the straddle 310 against the ID of the casing 34 and thus creating the seal between the expandable pipe section rubber and casing 34 ID. The grey colour gradient varies from light (low stress) to dark (high stress) illustrating increasing stresses in the expandable pipe section material.

When the expandable pipe section 318*a* makes full contact with the casing 34 ID the combined strengths of the casing 34 yield and the expandable pipe section 318*a* yield work together and give a higher strength pipe.

The expandable pipe section 318*a* material reaches the maximum required expansion, 42%, when it contacts the base casing 34 at approximately 5.4 ksi. Increased pressure does not increase the expansion, increased pressure only increases the width of the expanded section, i.e., more of the straddle is subjected to the 42% expansion, not that the expansion increases any further.

The increased expansion pressures do increase the bending in the transition zone between the expanded 318*a,b* and unexpanded 320,316*a,b* sections of the straddle 310. At 10 ksi there is significant bending in these end pieces and at the start of the transition from maximum strain through the end effected zone.

For the straddle 310 to seal into the base casing 34 in the well bore there must be residual contact pressure between the two. Contact pressure is an indicator of the likelihood of a seal and shows how and if the seal will fail. The higher the contact pressure, the more compressed the seal will be, and this generally implies that the seal will perform better.

Figure 9:
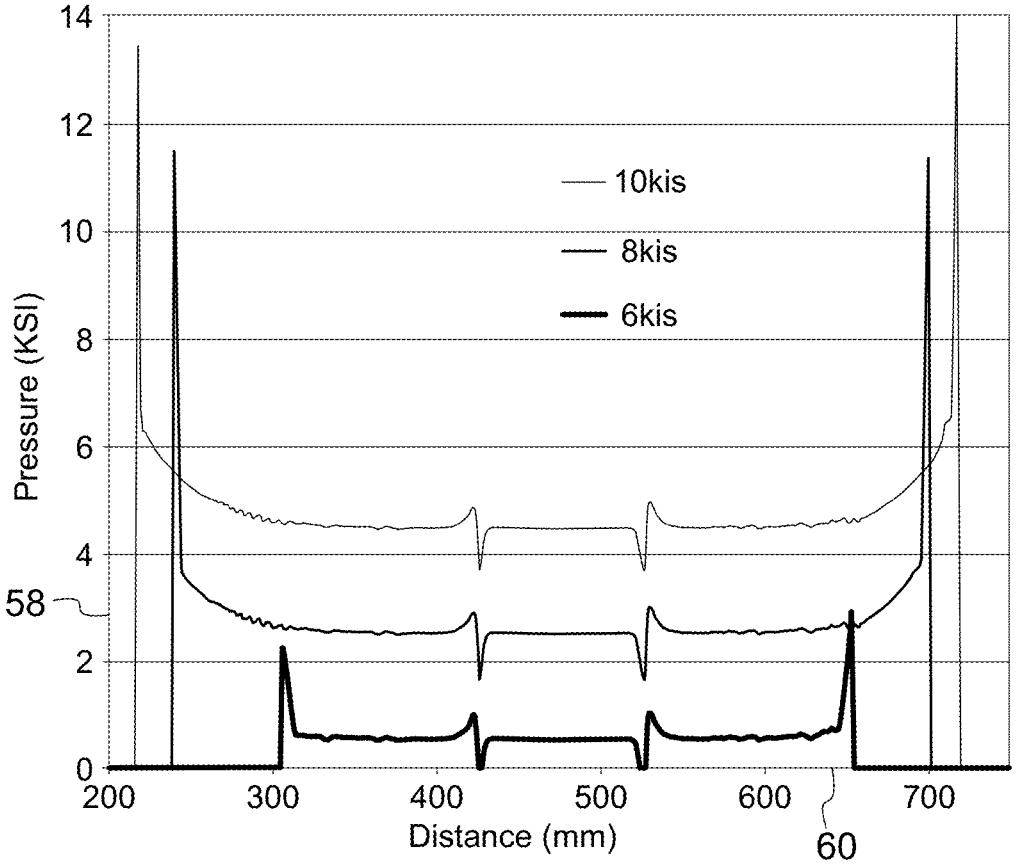
FIG. 9 is a graph of pressure versus distance for contact pressure distribution under increasing internal pressures.

The contact pressure 58 over distance 60 between the expandable pipe section 318*a* and 5.5" casing 34 is shown in the graph of FIG. 9. The simplified expandable pipe section 318*a* model does not include a rubber seal. Here the contact pressure increases from an average of 0.75 ksi with 6 ksi internal pressure through to 5 ksi at 10 ksi internal pressure. The ends of the contact zone typically show a peak in contact stress, while the central discontinuity indicates the zone of initial contact. This zone then experiences tiny amounts of axial deformation as the rest of expandable pipe section 318*a* comes into contact. This phenomenon is not likely to be seen when the rubber to metal contact is modeled. FIGS. 6,7 and 8 above also tie in with the contact pressure as they show the area of the casing under compression as the morphed pressure increases.

To test the quality of the seal in the contact zone, internal and external pressure is applied from one direction of the seal. This is an initial coarse simulation where pressure is applied along half of the contact face, even where the face is under high contact pressure. This then is a measure of the separation pressure required to open up the contact between the end pipe section and the casing and thus creating a leak path. As a general rule, this is an unrealistically worst case scenario.

To simulate this in FEA the internal pressure is held at 10 ksi, while the external pressure is slowly increased. The contact pressure starts to drop at around 4 ksi applied, while by ksi a 0.012" extrusion gap has opened up. This extrusion gap is a measure of the compression required for a rubber seal to maintain contact. Extrusion gaps of 0.007" to 0.02" are typical in the prior art packers, in these cases a rubber seal will be used to expand into the gap when the external pressure is applied.

Figure 10:
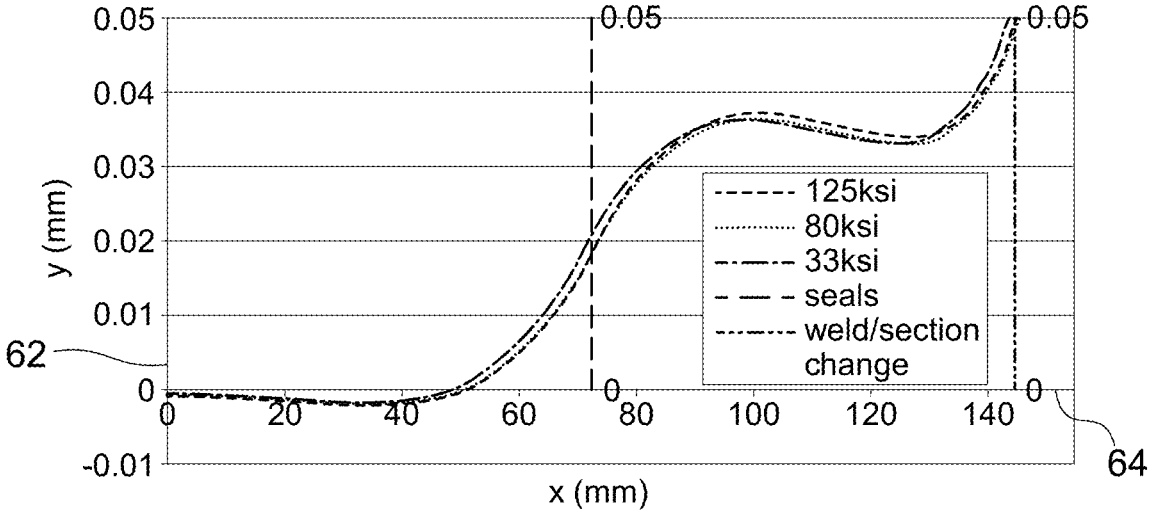
FIG. 10 is a graph of radial deformation versus length for increasing yield materials.

The straddle design 310 is simplified into thick and thin sections, the thin center section representing the expandable pipe sections 318*a,b* experiences yield pressure that forces expansion and eventual contact/seal with the casing 34 ID. The thick sections at the upper and lower ends are required to allow an expansion setting tool to seal against their ID so that pressure can be applied in isolation to the ID of the expandable section. These represent the base pipe 320 and the end pipe sections 316*a,b* the distal ends of the straddle 310. It is instructive then to examine how the end pieces deform under the pressure required to expand the thinner expandable pipe section. If a setting tool is used to apply the local pressure then the end pipe section pieces 316*a,b* will need to be stable to allow seal contact of the tool. The radial deformation 62 of the end piece under 10 ksi expansion pressure is shown in FIG. 10. The graph shows x coordinate 64 as axial length along the straddle end piece. Here a line is shown which approximates the seal contact area. Uphole of the contact area (to the left) does not experience expansion pressure, and downhole of the contact area, (to the right) will experience expansion pressure. The results of this reflect the candidate materials that can be proposed for end piece construction, from 125 ksi material through to 33 ksi yield 316 steel. It will be necessary to weld any candidate materials that differ from the 316 steel expandable pipe section to the 316 steel expandable pipe section.

Here the results show that even at 33 ksi yield material experiencing 10 ksi pressure, there is minimal radial deformation of approx. 0.02 mm (<0.001"). Given that there is a thick end piece envelope, at 3.35" OD and 2.44"ID, low yield strength material is a viable candidate. The 316 steel material used for the expansion pipe section is acceptable under these conditions. This is advantageous to the design because provides for the embodiment of FIG. 1(*a*) giving a construction of the straddle 10 without the need for welding.

The principal advantage of the present invention is that it provides a high expansion straddle which matches the requirement for a small OD of the straddle as run into the hole compared to the ID of the casing.

A further advantage is in the materials being austenitic stainless steels, specifically 316L which have the capability to meet the required expansion ratio and the corrosion needs.

The straddle can be advantageously constructed without welding for a small ID requirement through the straddle to suggest there is sufficient material wall thickness to potentially avoid welding high yield end pieces to a lower yield expansion section.

The invention claimed is:

1. A high expandable straddle to provide annular isolation in a well bore, comprising:

a. first and second expandable pipe sections;

b. a base pipe section located between the first and second expandable pipe sections, ends of the base pipe section having a continuous outer diameter; and c. first and second end pipe sections located at each end of the first and second expandable pipe sections respectively, and the first and second expandable pipe sections are mounted over the continuous outer diameter of the ends of the base pipe sections by overlapping joints;

d. the first and second expandable pipe sections being configured to expand radially outwards in contrast to the base pipe and end sections when pressure is applied to an inside surface of the pipe sections.

2. A high expandable straddle according to claim 1, wherein a wall thickness of the first and second expandable pipe sections is smaller than a wall thickness of the base pipe and end sections.

3. A high expandable straddle according to claim 2, wherein the straddle is of unitary construction with all the first and second expandable pipe sections and the base pipe section are formed of a first material.

4. A high expandable straddle according to claim 2, wherein the first and second expandable pipe sections are formed of a first material and the base pipe section and end pipe sections are formed of a second material, with the first material being more ductile than the second material.

5. A high expandable straddle according to claim 4, wherein the first material is a metal.

6. A high expandable straddle according to claim 5, wherein the metal is an austenitic stainless steel.

7. A high expandable straddle according to claim 4, wherein the second material is a metal being a low carbon steel alloy.

8. A high expandable straddle according to claim 1, wherein the first and second expandable pipe sections have a uniform outer diameter.

9. A high expandable straddle according to claim 8, wherein the first and second expandable pipe sections and the base pipe section are welded together end to end.

10. A high expandable straddle according to claim 4, wherein a portion of the first and second expandable pipe sections overlap a portion of the base pipe section and end pipe sections.

11. A high expandable straddle according to claim 1, wherein an anchoring arrangement is located on an outer surface of at least one of the expandable pipe sections.

12. A high expandable straddle according to claim 11, wherein the anchoring arrangement includes slips with gripping elements.

13. A high expandable straddle according to claim 1, wherein a deformable coating is placed on at least a portion of an outer surface of at least one of the expandable pipe sections.

14. A high expandable straddle according to claim 13, wherein the deformable coating is an elastomeric material.

15. A high expandable straddle according to claim 13, wherein the deformable coating is arranged as circumferential bands on the at least one of the expandable pipe sections.

16. A method of providing annular isolation at a location in a well bore, comprising the steps:

(a) locating a high expandable straddle on a tubular string;

(b) running the tubular string into a wellbore and positioning first and second expandable pipe sections at either side of the location within a larger diameter structure of the well bore;

(c) pumping fluid through the tubular string to cause the first expandable pipe section to move radially outwardly and morph against an inner surface of the larger diameter structure; and (d) pumping fluid through the tubular string to cause the second expandable pipe section to move radially outwardly and morph against an inner surface of the larger diameter structure, wherein ends of a base pipe section have a continuous outer diameter, and wherein the first and second expandable pipe sections are mounted over the continuous outer diameter of the ends of the base pipe section by overlapping joints.

17. A method of providing annular isolation at a location in a well bore according to claim 16, wherein the method includes at steps (c) and (d), creating over 30% expansion in outer diameter to the first and second expandable pipe sections.

18. A method of providing annular isolation at a location in a well bore according to claim 17, wherein the expansion is over 40%.

19. A method of providing annular isolation at a location in a well bore according to claim 16, wherein the method includes the steps of running in a hydraulic fluid delivery tool, creating a temporary seal at the end pipe sections to isolate a space and injecting fluid from the tool into the space to morph the first and second expandable pipe sections.

20. A high-expandable straddle system for annular isolation in a wellbore, comprising:

a first expandable pipe section and a second expandable pipe section;

a base pipe section located between the first and second expandable pipe sections, ends of the base pipe section having a continuous outer diameter;

first and second end pipe sections located at each end of the first and second expandable pipe sections, respectively;

wherein the first and second expandable pipe sections are mounted over the continuous outer diameter of connected to the ends of the base pipe section and end pipe sections by overlapping joints;

wherein the expandable pipe sections are configured to radially expand under internal pressure, forming a seal with the wellbore or casing, while the base and end pipe sections remain unexpanded under the same pressure conditions.

* * * * *